United States Patent [19]

Bencze

[11] Patent Number: 4,848,471

[45] Date of Patent: Jul. 18, 1989

[54] METHOD AND APPARATUS FOR TRANSPORTING UNPROCESSED WELL STREAMS

[75] Inventor: Istavan Bencze, Stavanger, Norway

[73] Assignees: Den Norske Stats Oljeselskap, Stavanger, Norway; ABB Atom Ab, VästerÅs, Sweden

[21] Appl. No.: 81,196

[22] Filed: Aug. 4, 1987

[30] Foreign Application Priority Data

Aug. 4, 1986 [NO] Norway ..... 863130

[51] Int. Cl.[4] ..... E21B 43/01; F04D 13/04; F17D 1/14

[52] U.S. Cl. ..... 166/335; 166/105; 166/369; 137/236.1; 137/565; 137/566

[58] Field of Search ..... 417/390, 391, 442; 166/347, 68.5, 357, 335, 267, 305.1, 369, 370, 68, 105; 137/236.1, 566, 565

[56] References Cited

U.S. PATENT DOCUMENTS

| | | | |
|---|---|---|---|
| 1,767,879 | 6/1930 | Grafenstatt | 417/391 |
| 1,828,857 | 10/1931 | Coberly | 417/391 |
| 2,432,079 | 12/1947 | Albert, Jr. | 417/390 |
| 2,614,803 | 10/1952 | Wiggins, Jr. | 166/68.5 |
| 2,898,866 | 8/1959 | Deackoff | 417/390 |
| 3,261,398 | 7/1966 | Haeber | 166/357 |
| 3,517,741 | 6/1970 | Roeder | 166/305.1 |
| 3,627,048 | 12/1971 | Roeder | 166/305.1 |
| 3,782,463 | 1/1974 | Palmour | 166/68 |
| 4,066,123 | 1/1978 | Skinner et al. | 166/68.5 |
| 4,243,102 | 1/1981 | Elfarr | 166/314 |
| 4,515,517 | 5/1985 | Sloan | 417/390 |
| 4,527,632 | 7/1985 | Chaudot | 166/68.5 X |

*Primary Examiner*—Bruce M. Kisliuk

*Attorney, Agent, or Firm*—Foley & Lardner, Schwartz, Jeffery, Schwaab, Mack, Blumenthal & Evans

[57] ABSTRACT

System for the transport of an unprocessed well stream comprising a multiphase, multicomponent mixture over long distances from one or several subsea wells A to a terminal F. The well stream, which is transported in one or several pipelines (10), running via at least one well A and to the terminal F, is supplied transport pressure by means of one or several fluid driven pumps (26) in the vicinity of the wells and/or fluid driven pipeline pumps (27) along the pipelines.

23 Claims, 10 Drawing Sheets

METHOD AND APPARATUS FOR TRANSPORTING UNPROCESSED WELL STREAMS

BACKGROUND OF THE INVENTION

1. Field of the Invention

The present invention relates to a system for transporting an unprocessed well stream comprising a multiphase, multicomponent mixture over a long distance from one or several wells to a terminal.

2. Related Art

Known field development concepts require that unprocessed well streams not be transported long distances from the wellheads. For underwater wellhead locations the distance, for instance between a well head and a processing plant, will be limited to a maximum of 10–15 km. The primary reason for this is that the reservoir pressure alone is not able to provide satisfying pressure levels for an economically justifiable long distance transport, as the pressure lost will lead to a lower field utilization. In deep water the positioning of fixed or floating processing plants close to the production wells will lead to considerable extra expense compared with placing plants onshore or in shallower water.

Another problem is the low operational flexibility of long distance pipelines, due to the fact that each pipeline is adapted to a fluid with particular phase characteristics. This requires considerable pretreatment of the well streams before the well streams can be introduced into long distance transport pipelines. This leads to considerable disadvantages when the field units are geographically separated by large distances. Another problem is that the well stream properties within the same field may vary, and also that considerable variation in the stream from each well may vary throughout the production period.

A third problem is related to the fact that transport pipelines of different types, for instance pressure classes, cannot be joined to each other without expensive additional installations offshore.

SUMMARY OF THE INVENTION

The object of the present invention is to provide a transport system which eliminates or strongly reduces the drawbacks mentioned above, and which facilitates the transport of well streams over distances of one hundred kilometers or more through underwater located pipelines without bringing the well stream to the surface for processing.

The object of the invention is achieved by a transport system which is characterized by supplying transport pressure to the well stream, which is transported in one or more pipelines running via at least one well to the terminal, by means of one or more fluid driven pumps in the vicinity of the wells and/or fluid driven pipeline pumps along the pipelines.

The transport system is based on pumps which are driven by fluids and which are able to pump single phase (gas or liquid) and multiphase, multicomponent mixtures (mixtures of gas and liquid in addition to solid particles). The driving fluid is a hydrocarbon or any other fluid known in the art which is transported from onshore, a fixed/floating installation or another well/-field. The energy of the drive fluid is derived from the energy of another well, another field or provided by means of other pressure generating methods known in the art.

The design of the transport system will vary from location to location and in relation to the production rate. The transport system is therefore optimized in each case.

BRIEF DESCRIPTION OF THE DRAWINGS

The invention will be explained in more detail in the following by means of examples of optional embodiments and by reference to the accompanying drawings wherein.

DETAILED DESCRIPTION OF THE INVENTION

Figure 1:
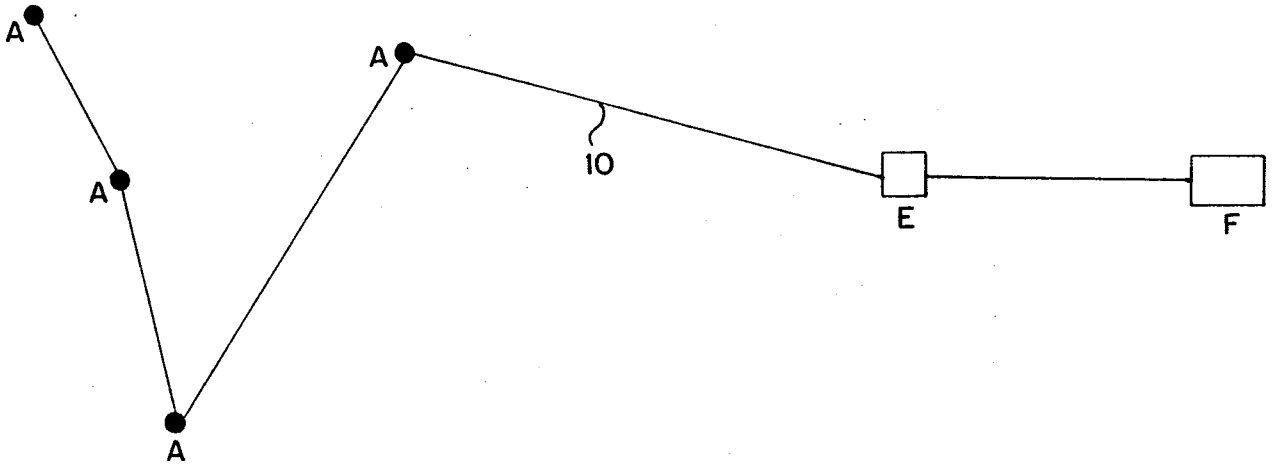
FIG. 1 shows a principal outline of the transport system.

In FIG. 1 there is shown a principal embodiment of the transport system which includes four subsea production wells A, a pipeline pump E and a terminal F. Arrangement is made for a transport pipeline 10 for the transportation of the well stream. The required transport pressure for the well stream, which ordinarily is composed of a multiphase, multicomponent mixture (mixture of gas and liquid in addition to solid particles), by means of several fluid driven pumps which, if necessary, are located in the vicinity of the well heads as well as boosters and/or along the pipeline as the pipeline boosters. The fluid for the operation of the fluid driven pumps will, as will be explained below, be supplied in various ways.

The following examples illustrate embodiments of the transport system outlined above.

Figure 2A:
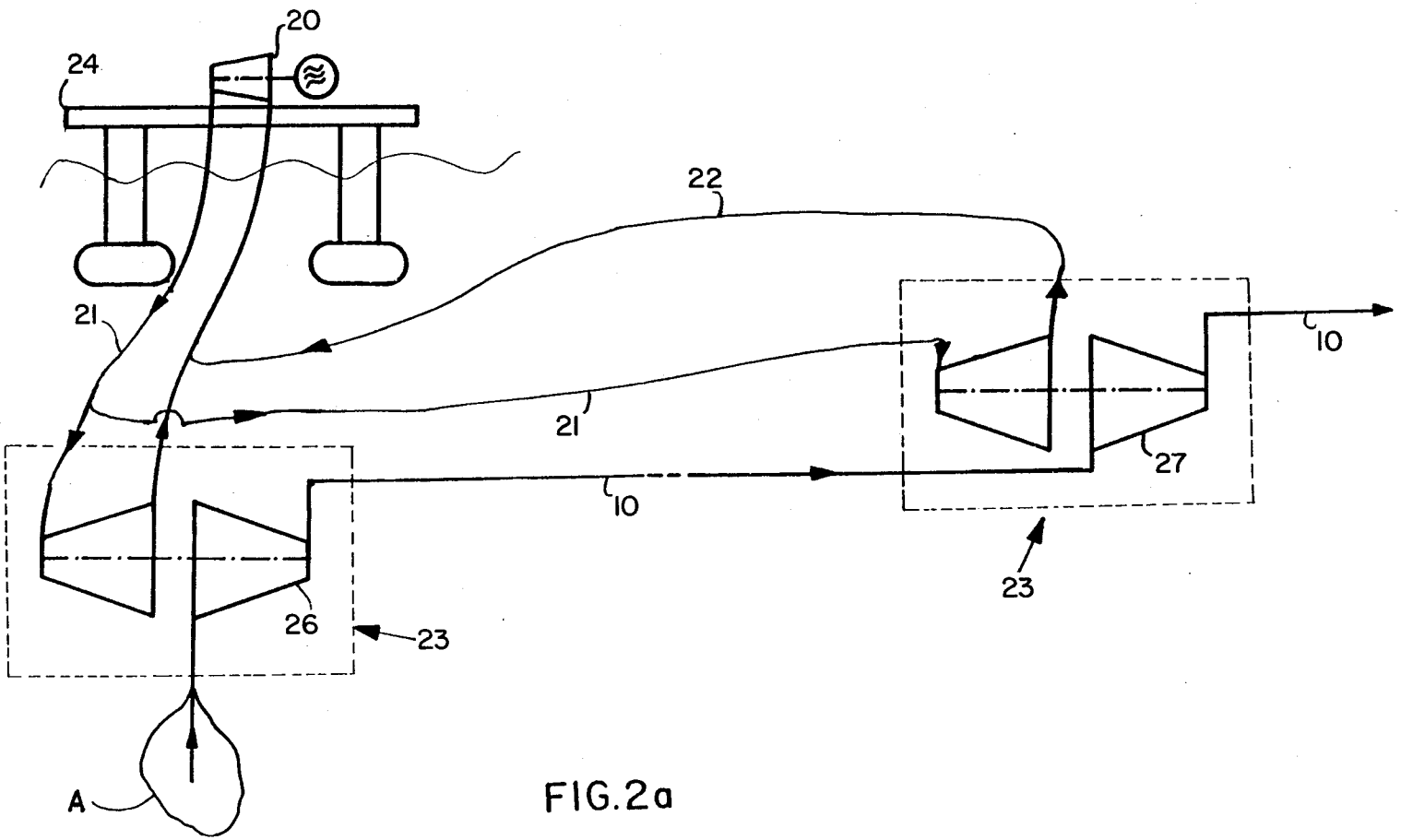
FIG. 2*a* and 2*b* show a transport system where the drive fluid of the fluid driven pumps is energized at respectively a floating installation and land/fixed installation and returned to the starting point.
Figure 2B:
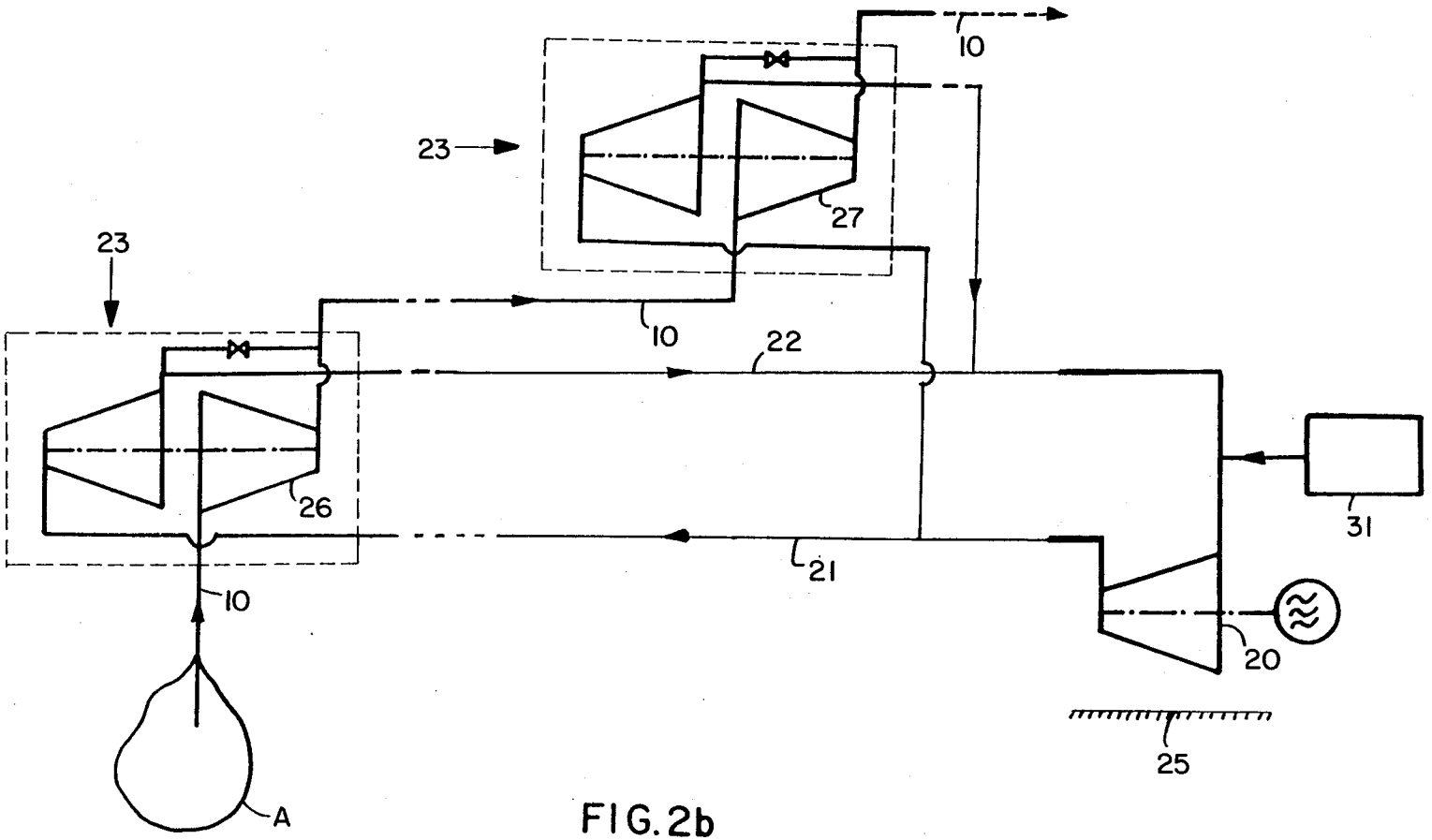

According to the first embodiment shown in FIGS. 2*a* and 2*b* energy is supplied to the driving medium at an energizing point 20, and the driving medium is conveyed in a supply line 21 to a plurality of fluid driven pumps 23 and returned in a return line 22 back to the energizing point 20. The energizing can occur on a floating installation 24 as indicated on FIG. 2*a*, or onshore/on fixed installation 25 as indicated on FIG. 2*b*. The fluid driven pumps 23, which in the figures are merely indicated in the form of a well pump 26 and a pipeline pump 27 both of which fluid driven, are connected in parallel to the driving fluids supply line 21 at the upstream portion of each of the pumps. The pumps are connected in parallel to return line 22 of the drive fluid at their downstream portions. Any suitable fluid can be used as a circulating drive medium. The embodiment shown is particularly adapted for the situation when the wells A and the pipeline 10 are located in deep water and when in addition the distance to a floating installation 24 or to an onshore/fixed installation 25 is relatively short.

Figure 3A:
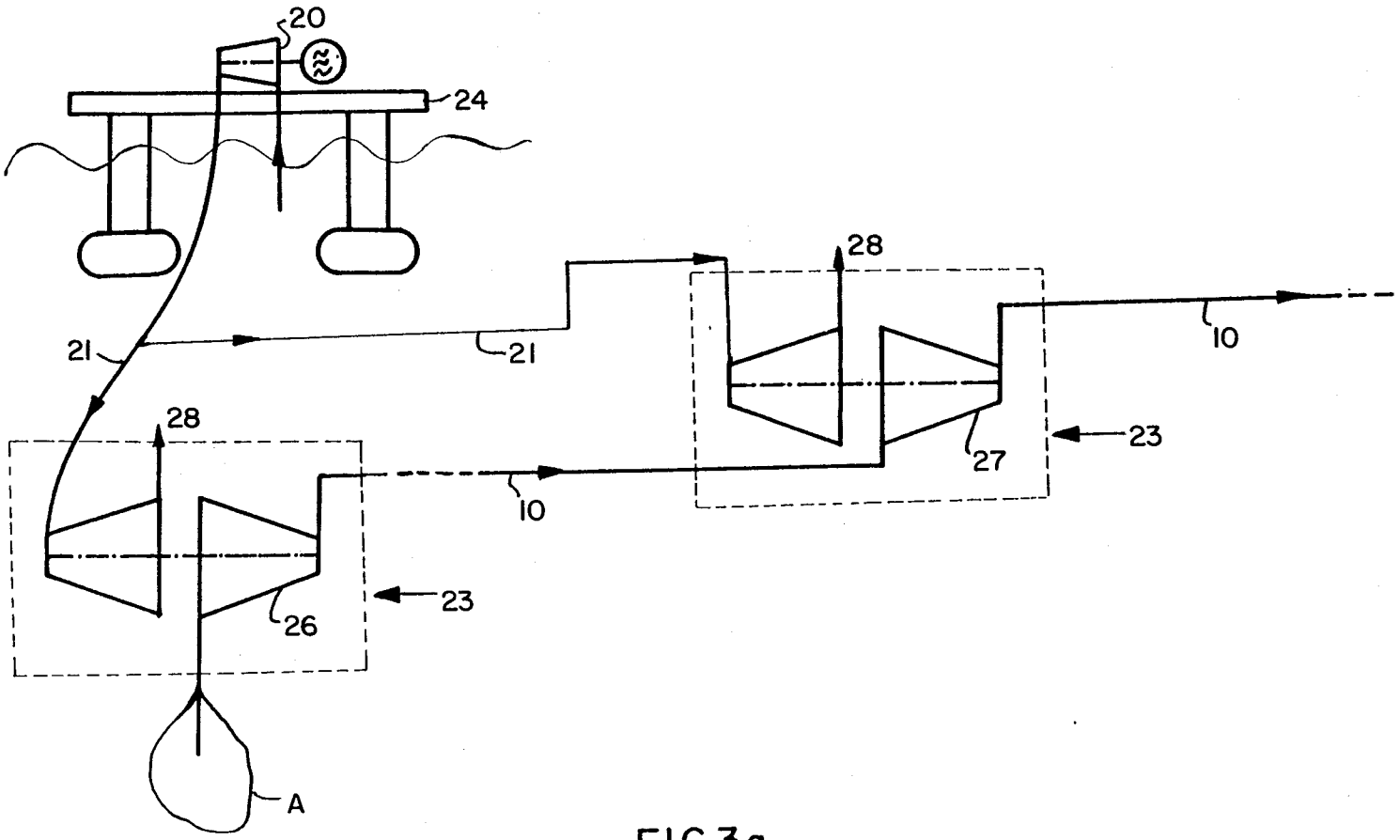
FIGS. 3*a* and 3*b* correspond to FIGS. 2*a* and 2*b* except that a drive fluid which can be discharged into the environment is used.
Figure 3B:
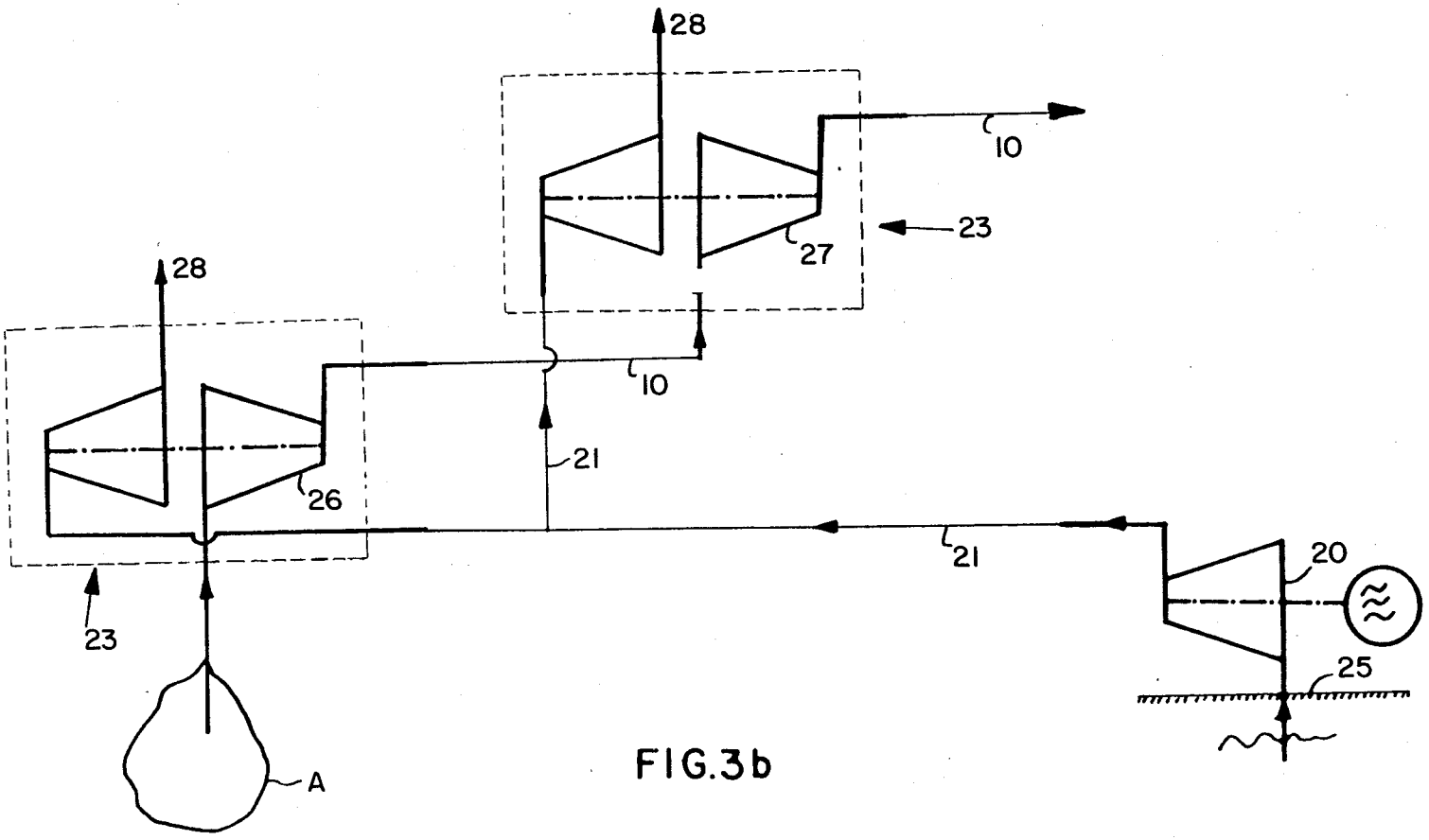

Another embodiment shown in FIGS. 3*a* and 3*b* is identical to the first embodiment, except that the drive medium used is seawater which is energized on a floating platform 24 as shown on FIG. 3*a* or onshore/on a fixed installation 25 as shown in FIG. 3*b*. The greatest advantage when utilizing seawater as a drive medium is that the return line can be omitted because the drive medium can be discharged into the environment, 28, at each fluid driven pump 23. This solution is also environmentally favorable as leakage from the drive line 21 will not cause pollution. This embodiment is particularly favorable in situations where the distance between the wells A/the pipeline 10 and the energizing point 20 is large because no return line 22 is required.

Figure 4:
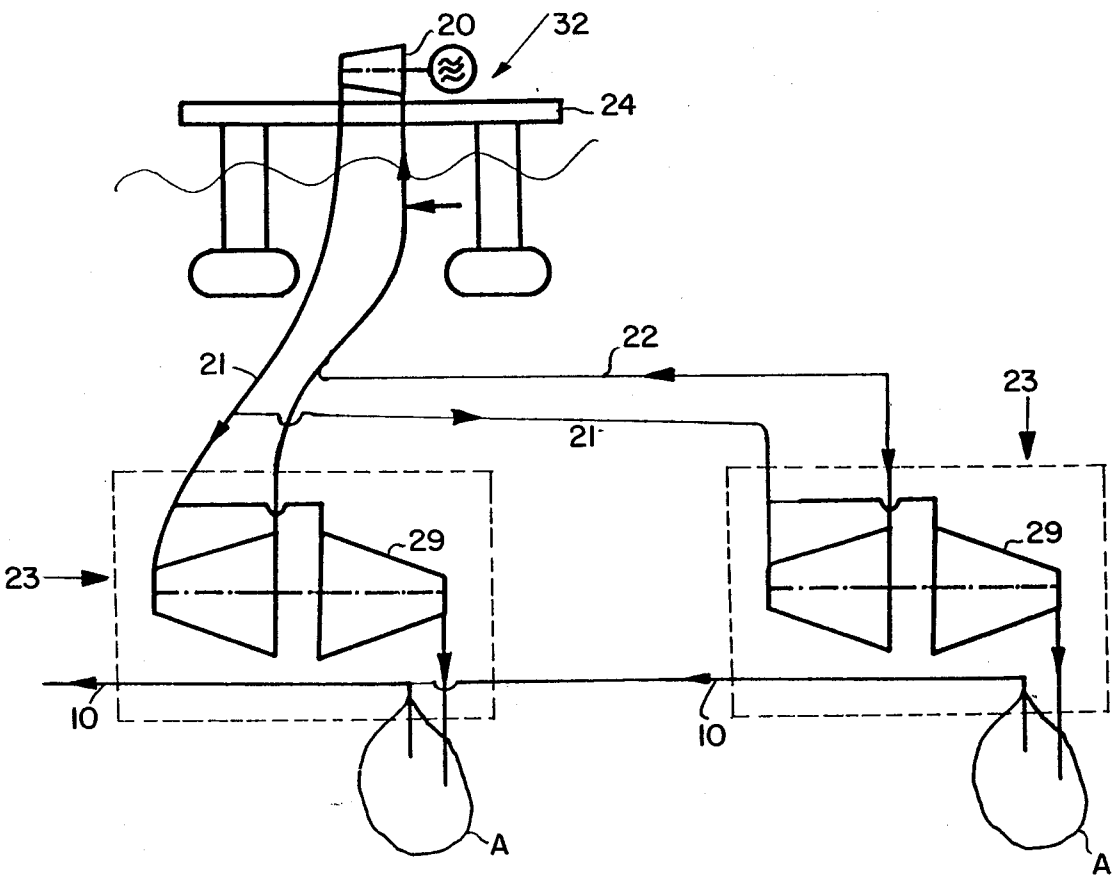
FIG. 4 shows the transport system employed before well injection.

A third embodiment in FIG. 4 shows the transport system according to the invention employed for pressure injection of several wells A in a field. The drive medium utilized is seawater which is treated in a water treatment unit 32 connected to the energizing point 20. The drive medium is pressurized before it is transported in the supply line 21 to which the fluid driven pump 23 is connected in parallel. Water being used for injection is taken from the drive line 21 and is conveyed via a plurality of injection pumps 29 down into the wells A. Return water from the driving portion of the fluid driven pumps 23 is carried in a separate return line 22 back to the energizing point. Water injected into the wells A is continuously replaced by seawater which is pumped up in connection with the water treatment unit 32. The water treatment unit 32 and the energizing point 20 are on FIG. 4 located on a floating installation 24 which ordinarily will be the most suitable; however, these units may of course also be located onshore/on a fixed installation 25 if desired.

Figure 5:
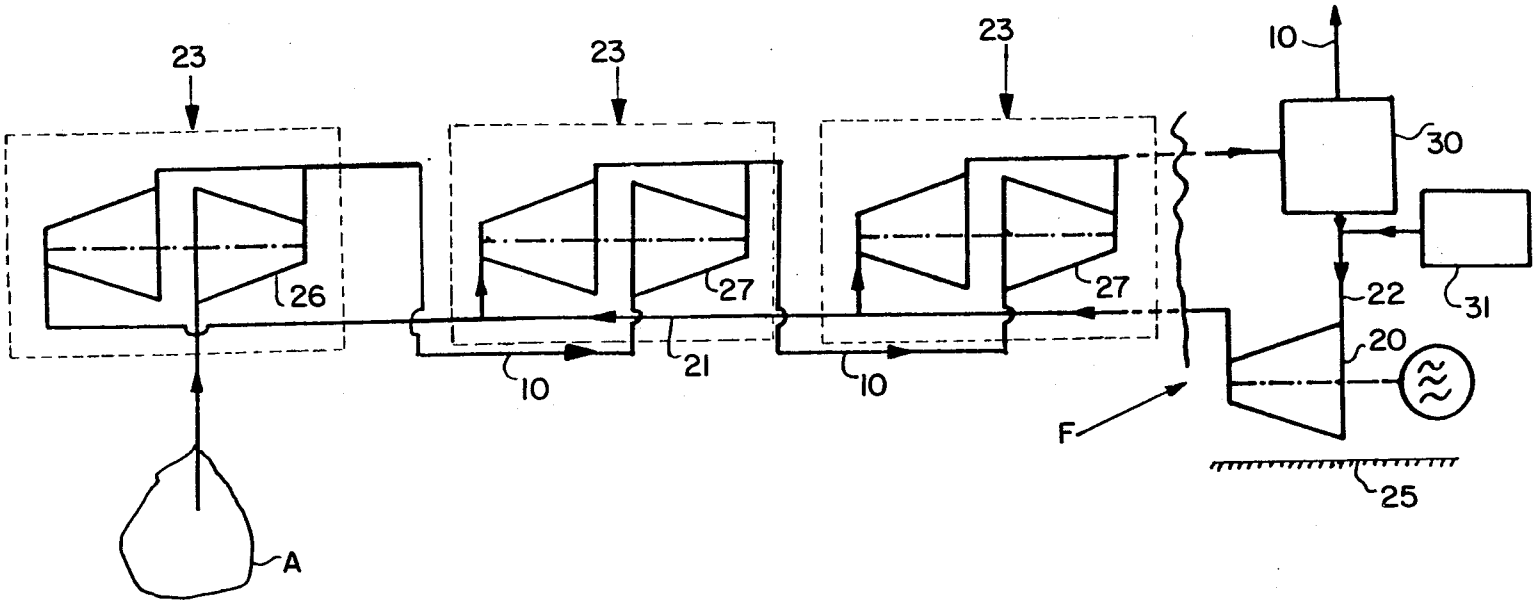
FIG. 5 shows a transport system where the drive fluid is returned along with the well stream.

In FIG. 5 a fourth embodiment is shown in association with a terminal F located onshore/on a fixed installation 25. The embodiment includes the energizing point 20 which pressurizes the drive medium in the supply line 21, and the fluid driven pipeline pumps 27 and/or well pumps 26 in a manner as previously explained are connected in parallel to the supply line 21. As in the previous embodiments the drive medium is returned to the terminal F by the pipeline for the well stream 10. Here the drive medium is separated from the well stream in a separator 30 and the separated drive medium is conveyed to the upstream portion of the pressurizing point 20. Between the separator 30 and the pressurizing point additives may be introduced by means of an injection unit 31, for instance to prevent hydrate formation. The advantages of this embodiment is related to the fact that no separate return line is needed for the drive fluid, that a drive fluid is utilized which for the purpose of maintenance is favorable and that addition of additives may be carried out in a simple manner. The embodiment is particularly suited when the distances between the wells A and the terminal F are great and when the wells A are located in deep water making maintenance difficult.

Figure 6B:
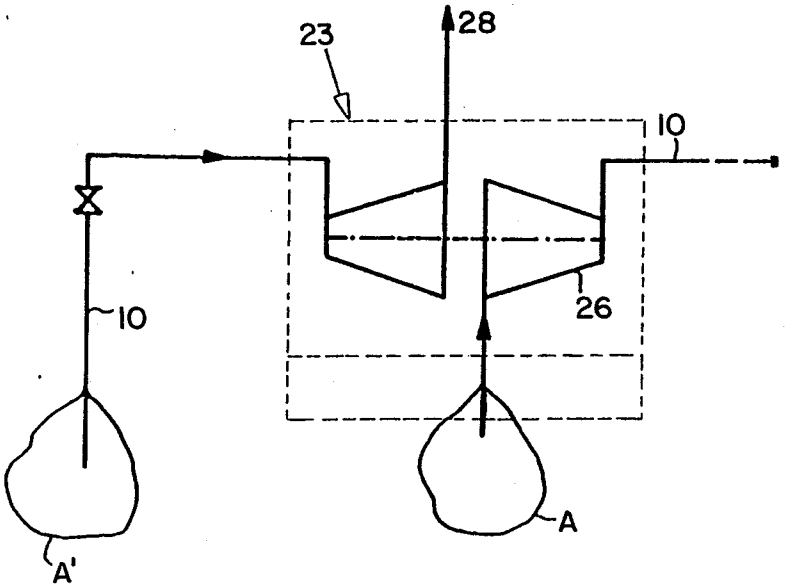
FIGS. 6*a* and 6*b* show operation of the transport system by means of energy from another well.
Figure 6A:
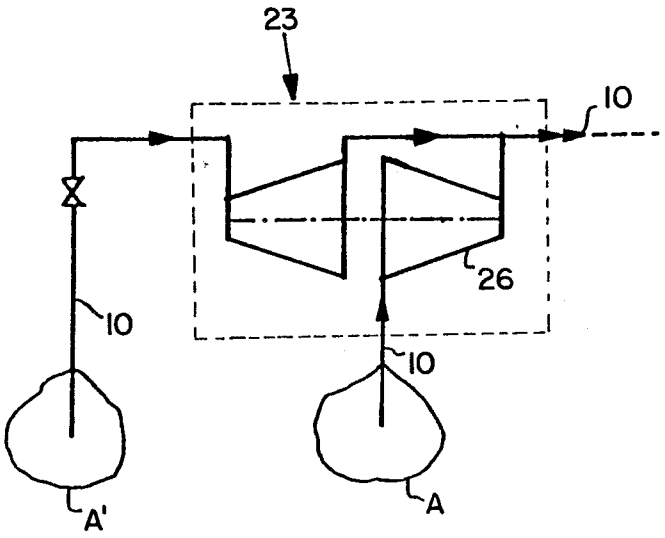

In the preceding examples of the embodiment the drive fluid for the fluid driven pumps 23 is pressurized on a floating installation 25 or onshore/on a fixed installation by means of a pressurizing device. In some cases however it may be possible to take advantage of the fact that the pressure in some of the wells A may be very high compared with the pressure in other wells. Therefore, it may be possible to let the low pressure wells be driven by the high pressure wells. In FIG. 6*a* such an embodiment is shown with a high pressure well A′ and a low pressure well A wherein the well stream from the high-pressure well A′ flows via the driving portion of a fluid driven pump 23 to a transport pipeline 10 while the well stream from the low pressure well A is transported via the pump 26 to the same pipeline 10. FIG. 6*b* shows a corresponding embodiment, in which however the well stream from a high pressure well A′ is of low economic value and is discharged into the environment 28.

Figure 7B:
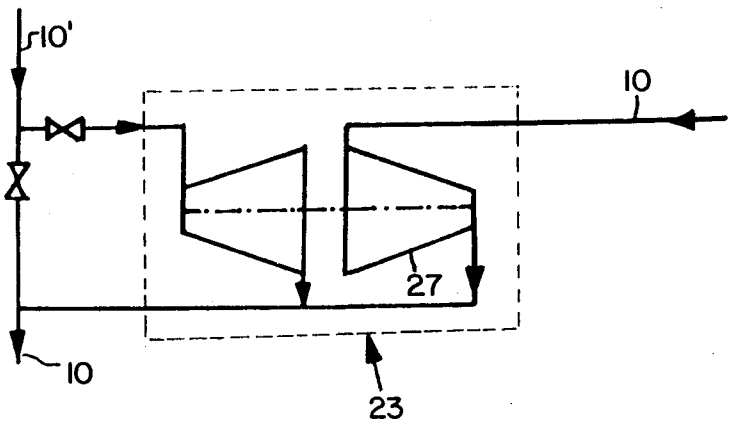
FIGS. 7*a* and 7*b* show operation of the transport system by means of energy from a pipe line from another field.
Figure 7A:
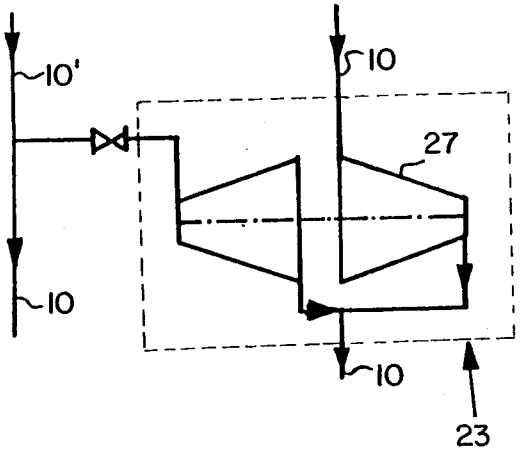

In a corresponding manner it may be possible to let a pipeline 10′ from a field with high pressure drive another pipeline 10 from field of low pressure, as shown on the FIGS. 7*a* and 7*b*. In the first case (FIG. 7*a*) the transport of the well stream continues into pipelines after the energy transfer, while the well streams in the second case (FIG. 7*b*) is joined in a common pipeline 10.

Figure 8:
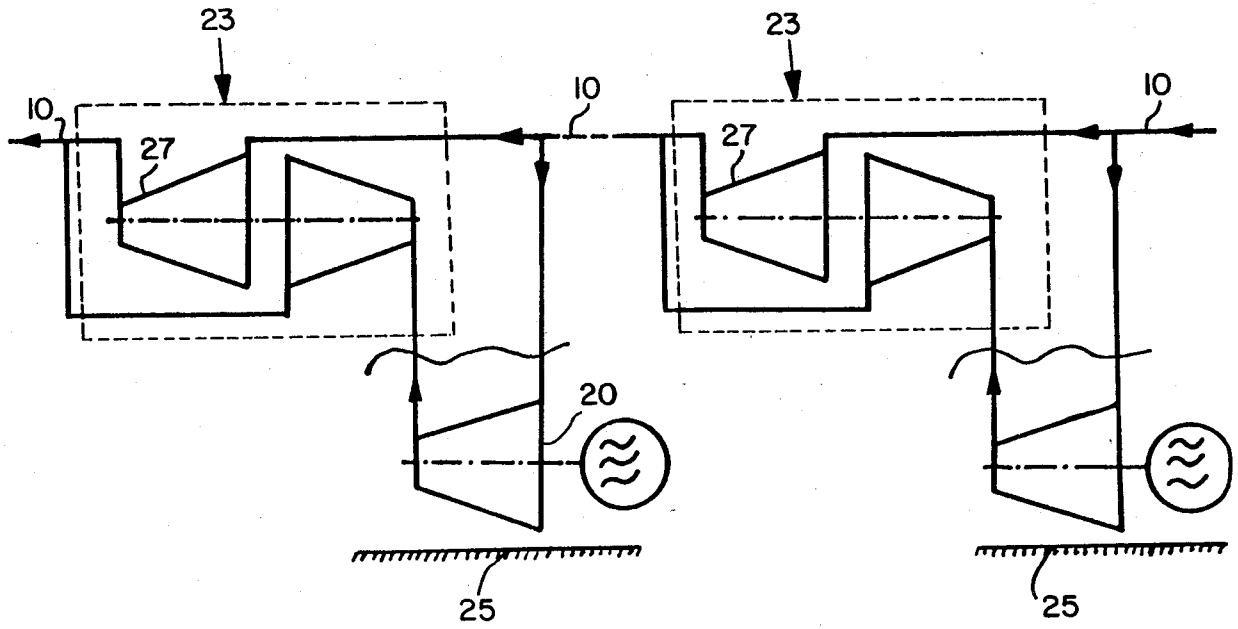
FIG. 8 shows operation of the transport system wherein energy is supplied to a fraction of the well stream, which thereafter is used as drive fluid.

As shown on FIG. 8 it will also be possible to pressurize the well stream in pipeline 10 by introducing a fraction of the well stream in a separate drive circle and by pressurizing either on a floating installation 24 or a fixed installation 25 and return it for the purpose of driving a fluid driven pump 23 which pressurizes the well stream itself. The fraction of the well stream which is utilized as drive fluid is returned to the pipeline after the pump 23.

In the preceding embodiments the transport system according to the invention has been described in schematic form. Various means required for the actual construction embodiment, such as valves, etc., are therefore not illustrated.

While several embodiments of the invention have been described, it will be understood that it is capable of further modifications, and this application is intended to cover any variations, uses, or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

What is claimed is:

1. A system for the transport of unprocessed well streams comprising at least a single phase, multicomponent mixture from at least one subsea well to a distant fixed terminal comprising:

(a) at least one fluid driven pump for transporting the well stream, and (b) means for pumping the well stream through at least one pipeline running via at least one well to the terminal disposed between the well and the terminal;

at least one of said fluid driven pumps having a driving portion connected to a drive fluid supply line and an outlet portion discharged into the sea.

2. Transport system according to claim 1, wherein a driving portion of the fluid driven pump is connected to a drive fluid supply line and an outlet portion is connected to a return line.

3. Transport system according to claim 1, wherein a drive fluid of the fluid driven pump comprises a pressurized hydraulic liquid.

4. Transport system according to claim 1, wherein a drive fluid of the fluid driven pump comprises pressurized seawater.

5. Transport system according to claim 4, characterized by the addition of additives to the drive fluid.

6. Transport system according to claim 1, wherein at least one fluid driven pump of a first well is driven by the well stream from a second well having a pressure higher than said first well.

7. Transport system according to claim 1, wherein at least one fluid driven pump of a first field is driven by energy from a pipeline stream from a second field having a higher pressure than said first field.

8. A method for the transport of unprocessed well streams comprising a multiphase, multicomponent mixture from a subsea well in a first field having a first pressure to a terminal comprising:

(a) providing at least one fluid driven pump for transporting the well stream;

(b) pumping the well stream through at least one pipeline running via at least one well to the terminal; and (c) driving at least one of the fluid driven pumps by energy from a pipeline stream from a second field having a pressure higher than said first field pressure.

9. The method of claim 8, including locating said fluid driven pump in the vicinity of the well.

10. The method of claim 8, including locating said fluid drive pump along the pipeline.

11. The method of claim 8, including providing a drive fluid to the fluid driven pump.

12. The method of claim 11, wherein the drive fluid is a hydraulic liquid which is pressurized.

13. The method of claim 12, wherein the hydraulic liquid is pressurized on a floating platform.

14. The method of claim 8, including connecting a driving portion of the fluid driven pump to a drive fluid supply line and the outlet portions of the fluid driven pump to a return line.

15. The method of claim 8, including connecting a driving portion of the fluid driven pump to a drive fluid supply line and discharging the outlet portions of the fluid driven pump into the sea.

16. The method of claim 8, wherein a drive fluid connected to the fluid driven pump comprises seawater which is pressurized.

17. The method of claim 16, wherein the seawater is treated and pressurized and conveyed via a drive fluid supply line to a drive inlet portion of the fluid driven pump and returned to a pressurized point via a return line, and by the pressure injected sea water being divided from the drive fluid supply line.

18. The method of claim 17, including separating the drive fluid from the well stream in a separator and transporting the drive fluid via an energizing point back to the drive fluid supply line.

19. The method of claim 8, including adding additives to the drive fluid.

20. A system for the transport of unprocessed well streams comprising at least a single phase, multicomponent mixture from at least one subsea well in a first field having a first pressure to a distant fixed terminal comprising:

(a) at least one fluid driven pump for transporting the well stream; and (b) means for pumping the well stream through at least one pipeline running via at least one well to the terminal disposed between the well and the terminal;

at least one of the fluid driven pumps having a driving portion connected to a pipeline stream from a second field having a pressure higher than said first field pressure.

21. A method for the transport of unprocessed well streams comprising a multiphase, multicomponent mixture from a subsea well to a terminal comprising:

(a) providing at least one fluid driven pump for transporting the well stream;

(b) pumping the well stream through at least one pipeline running via at least one well to the terminal;

(c) connecting a driving portion of the fluid driven pump to a drive fluid supply line; and (d) discharging an outlet portion of the fluid driven pump into the sea.

22. A method for the transport of unprocessed well streams comprising a multiphase, multicomponent mixture from a first subsea well having a first pressure to a terminal comprising:

(a) providing at least one fluid driven pump for transporting the well stream;

(b) pumping the well stream through at least one pipeline running via at least a first well to the terminal; and (c) driving at least one of the fluid driven pumps by energy from a well stream from a second well having a pressure higher than said first well pressure.

23. A system for the transport of unprocessed well streams comprising at least a single phase, multicomponent mixture from at least a first subsea well having a first pressure to a distant fixed terminal comprising:

(a) at least one fluid driven pump for transporting the well stream; and (b) means for pumping the well stream through at least one pipeline running via at least a first well to the terminal disposed between the well and the terminal;

at least one of the fluid driven pumps having a driving portion connected to a well stream from a second well having a pressure higher than said first well pressure.

* * * * *